US005590500A

United States Patent [19]

McCue

[11] Patent Number: 5,590,500

[45] Date of Patent: Jan. 7, 1997

[54] TILE SYSTEM

[76] Inventor: David L. McCue, 5832 Padua Dr., Huntington Beach, Calif. 92649

[21] Appl. No.: 139,452

[22] Filed: Oct. 20, 1993

[51] Int. Cl.[6] ..... E04F 13/00

[52] U.S. Cl. ..... 52/311.2; 52/384; 52/392; 52/396.1; 52/482; 52/506.01; 52/509

[58] Field of Search ..... 52/64, 311.2, 311.3, 52/315, 384, 385, 389–392, 476, 482, 506.1, 403.1, 509, 511, 764, 393, 395, 396.1, 386, 506.01

[56] References Cited

U.S. PATENT DOCUMENTS

| | | | |
|---|---|---|---|
| 2,026,511 | 12/1935 | Storm | 52/506.01 X |
| 3,335,048 | 8/1967 | Morain . | |
| 3,962,504 | 6/1976 | Sherwin . | |
| 4,143,496 | 3/1979 | Destito . | |
| 4,177,305 | 12/1979 | Feingold et al. . | |
| 4,546,024 | 10/1985 | Brown . | |
| 4,638,618 | 1/1987 | Iesaka et al. . | |
| 5,014,488 | 5/1991 | Evangelos et al. . | |
| 5,271,200 | 12/1993 | Witt | 52/385 X |

FOREIGN PATENT DOCUMENTS

| | | | |
|---|---|---|---|
| 2846717 | 5/1979 | Germany | 52/389 |

*Primary Examiner*—Robert J. Canfield
*Attorney, Agent, or Firm*—Patent Law & Venture Group Gene Scott

[57] ABSTRACT

A decorative and protective structural tile matrix for covering a base surface, such as a wall or countertop, is provided. A set of tiles comprise a subset of fixed tiles and a subset of removable tiles. The fixed tiles are permanently attached to the base surface by an adhesive. The removable tiles each provide a precast flexible grout sleeve of an elastomeric material, such as a plastic or rubber compound. The sleeve conforms to, and extends around, at least a portion of a peripheral edge of the removable tile. Each of the removable tiles takes a position between the fixed tiles such that the sleeve is compressed between the peripheral edges of the fixed tiles and the removable tile. As such, a compressive force is generated for holding each removable tile in place on the base surface. Alternatively, the sleeve is fixed to the base surface and has an outwardly extending frame defining pockets for insertion of a number of removable tiles. The removable tiles are held in the pockets by compressive forces applied to the frame from each adjacent tile. In use, the removable tiles may be exchanged with alternate removable tiles, such that an area decorated by a first set of removable tiles can be quickly given a new decorative appearance by replacing the first set of removable tiles with a second, different set of removable tiles.

10 Claims, 3 Drawing Sheets

TILE SYSTEM

FIELD OF THE INVENTION

This invention relates generally to decorative tiles, and, more particularly, is directed towards a decorative tile system that provides for readily interchanging one set of decorative tiles with another set of decorative tiles.

BACKGROUND OF THE INVENTION

Floors, walls, counter tops, and bathroom installations are often covered with a protective matrix of tiles, such as ceramic tiles. Often such tile-covered surfaces include a subset of decorative tiles that have additional colored designs and compliment the rest of the tile and the surrounding area. The adhesives typically used to fix tiles to a surface are typically permanent, as is the grouting material used to fill the gaps between the tiles. As a result, decorative tiles cannot be quickly interchanged with other, different decorative tiles. Thus, one must carefully choose the pattern of tile that is to be installed.

It is not uncommon for people to change the decor in their living areas every so often, and such change usually results in a new color scheme. However, in living areas where a decorative, permanent tile installation exists, often the color scheme cannot be changed too drastically because the colors already included with the permanent tile cannot be easily changed. Moreover, people often add decorations for approaching holidays, such as Christmas, that may call for different colors than are found in the current decor. It would clearly be desirable for one to easily interchange a decorative tile for another, perhaps holiday-oriented decorative tile.

While there are several prior art devices that teach removable and interchangeable tile systems, such prior art devices do not lend themselves well to ceramic tiles for countertops and walls, or the like. Instead, such prior art devices disclose wall hanging decorations, ceiling acoustic tile hanging systems, and the like.

Clearly, then, there is a need for a decorative tile system that allows certain tiles to be interchanged with other tiles easily. Such a needed device would securely hold a removable tile in place unless the tile was purposefully removed. Further, such a system would be moisture resistant and relatively inexpensive to manufacture, install, and maintain. The present invention fulfills these needs and provides further related advantages.

SUMMARY OF THE INVENTION

The present invention is a decorative and protective structural tile matrix for covering a base surface, such as a wall or countertop. A plurality of tiles comprise a subset of fixed tiles and a subset of removable tiles. The fixed tiles are permanently attached to the base surface by an adhesive. Each fixed tile is mutually separated from adjacent fixed tiles so as to define a space therebetween which is filled by a grout material for improved holding of the fixed tiles and improved appearance thereof. The removable tiles each provide a precast flexible grout sleeve of an elastomeric material, such as a plastic or rubber compound. The sleeve conforms to, and extends around, at least a portion of a peripheral edge of the removable tile. Each of the removable tiles takes a position between the fixed tiles such that the sleeve is compressed between the peripheral edges of the fixed tiles and the removable tiles. As such, a compressive force is generated for holding each removable tile in place on the base surface. Alternatively, the sleeve is fixed to the base surface and has an outwardly extending frame defining pockets for insertion of a number of removable tiles. The removable tiles are held in the pockets by compressive forces applied to the frame from each adjacent tile, all of which adjacent tiles press against opposite sides of an intermediate portion of the frame to retain the removable tile in the pocket.

In use, the removable tiles may be removed and replaced by alternate removable tiles. As such, an area decorated by a first set of removable tiles can be quickly given a new decorative appearance by replacing the first set of removable tiles with a second, different set of removable tiles.

The present invention is a decorative tile system that allows removable tiles to be interchanged with other removable tiles easily. The present invention securely holds the removable tile in place unless the tile is purposefully removed. Further, the present invention is moisture resistant and relatively inexpensive to manufacture, install, and maintain. Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 3:
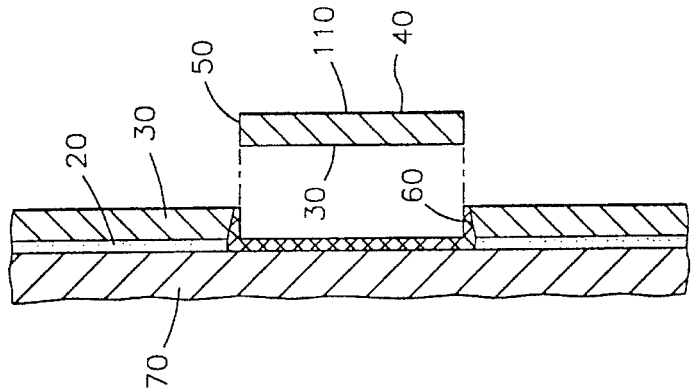
FIG. 3 is an exploded cross-sectional view of the invention, taken generally along lines 2—2 of FIG. 1, illustrating the sleeve of FIG. 2 as held between two adjacent fixed tiles.
Figure 2:
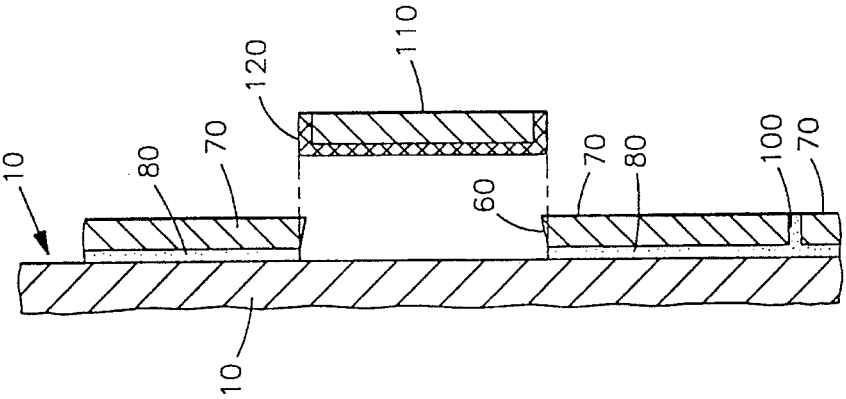
FIG. 2 is an exploded cross-sectional view of the invention, taken generally along lines 2—2 of FIG. 1, illustrating a flexible sleeve extending around a removable tile.
Figure 1:
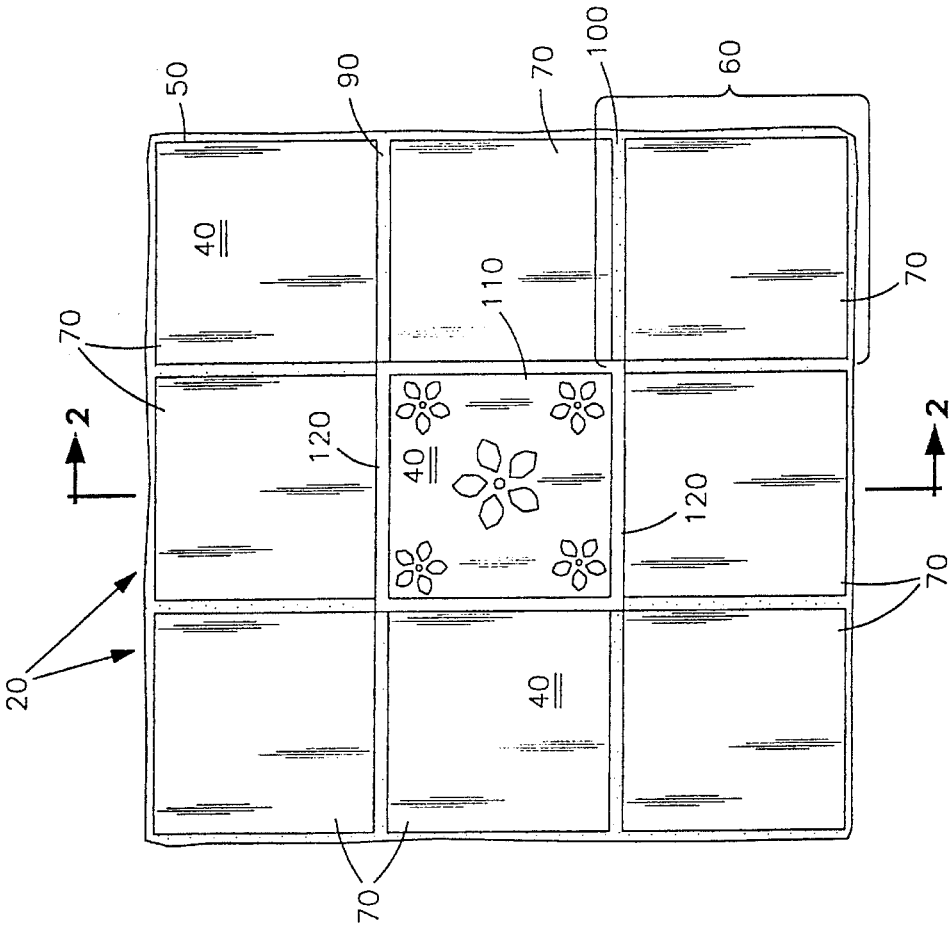
FIG. 1 is a front elevational view of the invention, illustrating a removable tile surrounded by a number of fixed tiles.

FIG. 1 and 2 show a decorative and protective structural tile matrix for covering a base surface 10, such as a wall or countertop. A plurality of tiles 20 each provide a generally planar mounting surface 30 for placement in essentially parallel proximity to the base surface 10. The mounting surface 30 may include ridges or other features (not shown) for spacing or adhesive holding purposes. The tiles 20 are manufactured from any suitable rigid material, such as ceramic, day, stone, glass, metal, wood, or the like. Each tile 20 includes a generally planar display surface 40 which is joined to the mounting surface 30 by a peripheral edge 50 that defines an outline shape 60 of the tile 20.

A first subset of the tiles 20, referred to as the fixed tiles 70, are permanently attached by the mounting surface 30 to the base surface 10 by an adhesive means 80. Such an adhesive means 80 may be an adhesive compound such as "Thin Set," "Mastic," or the like. Each fixed tile 70 is mutually separated from adjacent fixed tiles 70 so as to define a space 90 therebetween which is filled by a grout material 100 for improved holding of the fixed tiles 70 and improved appearance thereof. Preferably all of the spaces 90 between each fixed tile 70 are nearly the same in dimension.

A second subset of the tiles 20 are referred to as the removable tiles 110. Each removable tile 110 provides a precast flexible grout sleeve 120 of an elastomeric material, such as a plastic or rubber compound. The sleeve 120 conforms to, and extends around, at least a portion of the peripheral edge 50 of the removable tile 110. As the sleeve 120 is made of an elastomeric, compressible material, the sleeve 120 conforms to tiles 110 of naturally slightly varying sizes. The sleeve 120 may also be made to extend between the base surface 10 and the mounting surface 30 of the removable tile 110 for improved support thereof on the base surface 10, and may be made in any of a wide variety of colors. Preferably, however, the sleeve 120 is the same color as the grout material 100.

Figure 4B:
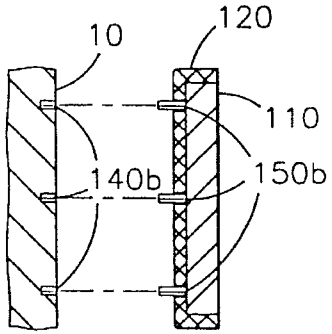
FIG. 4B is a partial cross-sectional view of the invention, illustrating an alternate first and second mechanical interlocking means for holding the movable tile to the base surface.
Figure 4A:
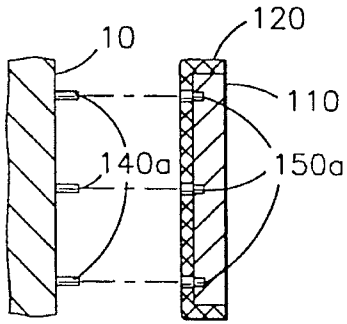
FIG. 4A is a partial cross-sectional view of the invention, illustrating a first and second mechanical interlocking means for holding the removable tile to the base surface.

In one embodiment of the invention, the sleeve 120 may be fixed to the base surface 10 by an adhesive or mechanical interlocking means **140*b*,150*b* (FIG. 4B) for improved holding of the removable tile 110 onto the base surface 10. In such an embodiment, the removable tile 110 may be readily removed from the sleeve 120, the sleeve 120 remaining attached to the base surface 10. Alternatively, the base surface 10 includes a first mechanical interlocking means 140*a* (FIG. 4A), and each of the removable tiles further provides mating second mechanical interlocking means 150*a* for engaging the first mechanical interlocking means 140*a* to hold the removable tiles 110 removable to the base surface 10**.

Figure 5:
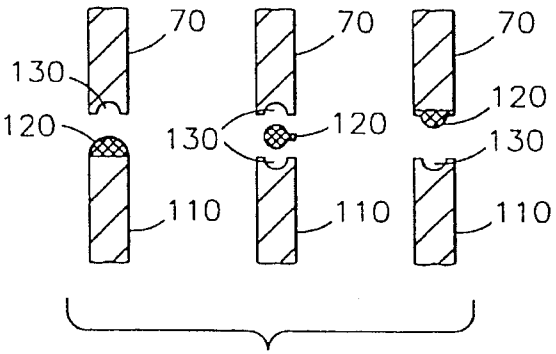
FIG. 5 is a partial cross-sectional view of three embodiments of the invention, illustrating an indented groove in the fixed tile of the invention, an indented groove in a removable tile of the invention, or the indented groove in both the fixed and removable tile of the invention.
Figure 7:
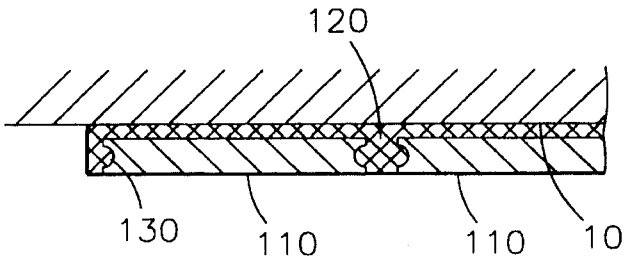
FIG. 7 is a partial cross-sectional view of the invention, taken generally along lines 7—7 of FIG. 6, showing the indented groove in the peripheral edge of the removable tile, and the sleeve of the invention.

In an alternate embodiment of the invention, the peripheral edge 50 of each of the fixed tiles 70, each of the removable tiles 110, or all of the tiles 20 includes an indented groove 130 for interlocking with the sleeve 120 for improved holding of the removable tiles 110 (FIGS. 5 and 7).

Figure 6:
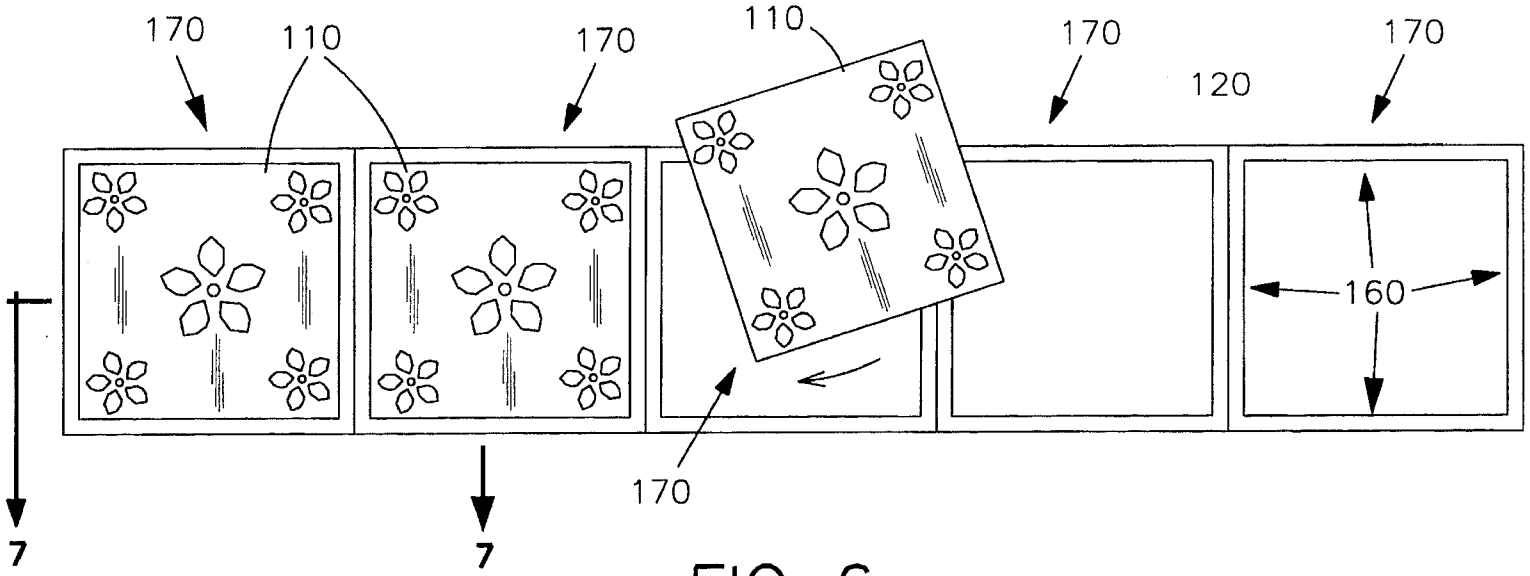
FIG. 6 is a front elevational view of the invention, illustrating an embodiment wherein the sleeve of the invention includes a frame that defines pockets for receiving the removable tiles of the invention.

Each of the removable tiles 110 takes a position between the fixed tiles 70 such that the sleeve 120 is compressed between the peripheral edges 50 of the fixed tiles 70 and the removable tiles 110. As such, a compressive force is generated for holding each removable tile 110 in place on the base surface 10. In an alternative embodiment of the invention, the sleeve 120 is fixed to the base surface 10 and has an outwardly extending frame 160 defining pockets 170 for insertion of the removable tiles 110 (FIGS. 6 and 7). Each pocket 170 is of a shape to conform to the outline shape 60 of the removable tiles 110, such that the removable tiles 110 are held in the pockets 170 by compressive forces applied to the frame 160 from each adjacent tile 20, all of which adjacent tiles 20 press against opposite sides of an intermediate portion of the frame 160 to retain the removable tile 110 in the pocket 170. In this embodiment, the frame 160 is made from a more rigid rubber or plastic compound than is the single sleeve 120 so as to provide additional retentive forces to the removable tiles 110 within the pockets 170.

In use, the removable tiles 110 may be removed and replaced by alternate removable tiles 110. As such, an area decorated by a first set of removable tiles 110 can be quickly given a new decorative appearance by replacing the first set of removable tiles 110 with a second, different set of removable tiles 100. Such alternate removable tiles 110 may include holiday themes, such as Christmas, Thanksgiving, Independence Day, and the like. Other themes might include "Happy Birthday," "Congratulations," "Happy Mother's Day," or utilize colors traditionally associated with various seasons of the year, and so forth. Further, removable tiles 110 may be of various shapes and irregular sizes not necessarily like those of the fixed tiles 70. The removable tiles 110 might also include three-dimensional relief images, tiles-within-a-tile, or other decorative arrangements (not shown).

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. A decorative and protective structural matrix covering a base surface comprising:

a plurality of tiles of a rigid material, each of the tiles providing a generally planar mounting surface for placement, in parallel proximity, to the base surface, and a generally planar display surface, the surfaces being joined by a peripheral edge defining an outline shape;

a first subset of the plurality of tiles, each being a fixed tile permanently attached by the mounting surface to the base surface by an adhesive means, each, further, being mutually separated from the next to define a space therebetween, a grout material filling each said space;

a second subset of the plurality of tiles, each being a removable tile, each providing a precast flexible grout sleeve of an elastomeric material, the sleeve shaped to conform to, and extend around, at least a portion of the peripheral edge;

each of the removable tiles positioned between fixed tiles such that each sleeve is compressed between the peripheral edges of the fixed and removable tiles to generate a compressive force for holding each removable tile in place adjacent the base surface.

2. The decorative and protective structural matrix of claim 1 wherein the precast flexible grout sleeves is fixed to the base surface for improved holding of the removable tiles on the base surface while enabling the removable tiles to be removed therefrom for replacement.

3. The decorative and protective structural matrix of claim 1 wherein the peripheral edge of each of the fixed tiles provides an indented groove for interlocking with the precast flexible grout sleeves for improved holding of the removable tiles.

4. The decorative and protective structural matrix of claim 1 wherein the peripheral edge of each of the removable tiles provides an indented groove for interlocking with the precast flexible grout sleeves for improved holding of the removable tiles.

5. The decorative and protective structural matrix of claim 1 wherein the peripheral edges of each of both the fixed tiles and the removable tiles provides an indented groove for interlocking with the precast flexible grout sleeves for improved holding of the removable tiles.

6. The decorative and protective structural matrix of claim 1 wherein the base surface includes first mechanical interlocking means, and each of the removable tiles further provides mating second mechanical interlocking means for engaging the first mechanical interlocking means to hold said removable tiles removably to the base surface.

7. The decorative and protective structural matrix of claim 1 wherein the elastomeric material is taken from the set of materials including plastics and rubbers.

8. The decorative and protective structural matrix of claim 1 wherein the sleeves extend between the base surface and the mounting surface of the removable tiles for improved support thereof.

9. The decorative and protective structural matrix of claim 1 wherein the peripheral edge of each of the tiles provides an indented groove for interlocking with the sleeves for improved holding of the tiles.

10. A decorative and protective structural matrix covering a base surface including first mechanical interlocking means, the matrix comprising:

a plurality of tiles of a rigid material, each of the tiles providing a generally planar mounting surface including a mating second mechanical interlocking means positioned and adapted on the mounting surface for engaging the first interlocking means of the base surface, each of the tiles positioned in parallel proximity, to the base surface, first and second interlocking means being mutually engaged, and further including a generally planar display surface, the mounting surfaces and display surfaces being joined by a peripheral edge defining an outline shape; and a precast flexible grout sleeve of an elastomeric material, fixed to the base surface and having an outwardly extending frame defining pockets for insertion of the tiles, the pockets being of a shape to conform to the outline shape of the peripheral edge of each of the tiles, whereby the tiles are held in the pockets by compressive forces applied to the frame from each two adjacent tiles, each pressing against opposite sides of an intermediate portion of the frame, the forces being transferred to the peripheral edges of the tiles.

* * * * *